US006164230A

United States Patent [19]

Beauchamp

[11] Patent Number: 6,164,230

[45] Date of Patent: Dec. 26, 2000

[54] PASSIVE SYSTEM FOR MITIGATION OF THRUSTER WAKE DEFICIT

[75] Inventor: Charles H. Beauchamp, Jamestown, R.I.

[73] Assignee: The United States of America as represented by the Secretary of the Navy, Washington, D.C.

[21] Appl. No.: 09/378,120

[22] Filed: Aug. 20, 1999

[51] Int. Cl.[7] ..... B63H 25/46

[52] U.S. Cl. ..... 114/151; 440/38

[58] Field of Search ..... 114/151; 440/38, 440/47

[56] References Cited

U.S. PATENT DOCUMENTS

| | | | |
|---|---|---|---|
| 3,710,748 | 1/1973 | Baer et al. | 114/151 |
| 3,874,316 | 4/1975 | Lorenz | 114/151 |
| 4,008,676 | 2/1977 | Brix | 114/151 |
| 4,018,181 | 4/1977 | Brix | 114/151 |
| 5,642,684 | 7/1997 | Aker | 114/151 |

*Primary Examiner*—Stephen Avila
*Attorney, Agent, or Firm*—Michael J. McGowan; Prithvi C. Lall; Michael F. Oglo

[57] ABSTRACT

A marine vehicle having enhanced maneuverability, which has a hull at least partially submerged in water. The vehicle has a forward bow, a longitudinal axis extending rearwardly from said bow and opposed first and second sides. The first and second sides have respectively a first major opening and a first small opening and a second major opening and a second small opening. The small openings are positioned rearwardly of the first small opening. A major water conducting tunnel extending generally transversely through the hull from the first major opening on the first side of the hull to the second major opening on the said side of the hull. There is a propeller for causing water to flow through the tunnel. A small water conducting system extends between the first small opening on the first side of the hull to the second small opening on the second side of the hull. This system has a first tube that connects the first small opening with the tunnel, and a second tube, which connects the tunnel with the second small opening.

10 Claims, 2 Drawing Sheets

PASSIVE SYSTEM FOR MITIGATION OF THRUSTER WAKE DEFICIT

CROSS REFERENCE TO RELATED PATENT APPLICATION

The instant application is related to a co-pending U.S. Patent Application entitled BAFFLE SYSTEM FOR MITIGATION OF THRUSTER WAKE DEFICIT (Ser. No. 09/378,119) and filing date of Aug. 20, 1999.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to marine vehicles and more particularly to lateral thrusters for use therein.

(2) Brief Description of the Prior Art

Marine vehicles often are required to maneuver at very low speeds and hover in currents. Marine vehicles typically use rudders or other control surfaces to produce maneuvering forces. However, flow over the control surfaces is required to produce a maneuvering force and these forces vary with the square of the vehicle speed. Therefore, at low speed, control surfaces become ineffective. Typically, lateral tunnel thrusters are located in the bow or stern of marine vehicles to meet the low speed maneuvering requirements. However, the effectiveness of tunnel thruster decreases with forward velocity of the vehicle. Often there is an intermediate vehicle speed at which neither the control surfaces nor the thruster produce effective maneuvering forces.

Conventionally, thrusters make use of a rotating propeller in a tunnel through the vehicle. The rotating propeller creates a pressure differential across the blades and drives a jet of water through the tunnel and out one side. The integrated pressure force on the blades is transferred to the vehicle via the rotor hub and force acting in the opposite direction of the jet flow. This effect is used to maneuver the vehicle. In the current art thrusters are designed to be reversible and so that the vehicle may be maneuvered in either port or starboard directions.

Early efforts to measure the effects of forward vehicle velocity on tunnel thruster performance have shown that as the forward velocity was increased to speed on the order of 3 knots, the effective side force (force perpendicular to the vehicle axes) from the tunnel thruster decreased to as low as 10 percent of the side force measured at zero maneuvering effectiveness as forward vehicle velocity. Thus with the current art tunnel thruster quickly lose their maneuvering effectiveness as forward vehicle velocity increases. Experiments conducted to understand this phenomenon indicated that the forward velocity does not significantly alter the force acting on the vehicle through the propeller hubs. However, the thruster jet acts as an obstruction to the boundary layer flow over the vehicle hull. This produces a wake deficit in the boundary layer downstream of the thruster's jet. The resulting wake-induced pressure deficit on the vehicle surface generated an integrated suction force on the hull that counteracts the force on the blades. Conversely, on the suction side of the tunnel due the vehicle boundary layer being sucked off by the thruster. The integrated force in this high-pressure region also counteracts the force on the thruster blades.

Tunnel thrusters are typically reversible. That is, the blades can be rotated clockwise to produce a jet in either direction to maneuver the vehicle. Thus any device that is deployed to mitigate the effects of forward velocity must also be reversible.

Various specific arrangement of tunnel thrusters are shown in the prior art.

U.S. Pat. No. 3,408,974 to Pehrsson, for example, discloses a ship steering system which includes tunnels extending transversely through a ship's hull at the bow or stern or both in which is mounted a reversing or reversible pitch propeller in order to pump water selectively through the tunnel to exert a steering force on the hull and including vanes or screens which can be extended outwardly form and withdrawn into the hull located behind the ends of the tunnel or tunnels in the direction of movement of the ship in order to exert a turning force on the hull and also to direct water selectively into the tunnel during the forward or rearward movement of the ship to enable control of the steering of the ship either at low or high speed.

U.S. Pat. No. 3,710,748 to Baer et al. discloses a longitudinal flow passage which opens at the bow of a ship and has impeller means therein with first and second discharge flow passages branching from the longitudinal passage behind the impeller and opening on both sides of the hull. Controllable valve means in the discharge flow passages control the flow of water being discharged from openings whose rear edges project outwardly of the hull surface a distance about one fourth of the width of the discharge opening.

U.S. Pat. No. 3,830,184 to Krautkremer discloses an attachable or a detachable unit providing a lateral thrust rudder for ships. The invention contemplates a unitary mechanism constituting a tunnel, a propeller within such tunnel and driving means for same which can be bodily mounted into or detached from a ship. When same is in operating position, it is normally mounted at the bow of the ship and functions to apply a lateral thrust in one direction or the other as desired to such bow. The unit is mounted so that the driving mechanism projects into the interior of the ship for easy access thereto. Suitable drive mechanism and control features, including pitch-changing means for the propeller blades are also provided.

U.S. Pat. No. 4,008,676 to Brix discloses a water craft which has a hull with a cavity communicating with a sea opening below water level. A conduit formation in the hull has one end opening on a side of the hull directly adjacent the sea opening and below water level and is connected through the interior of the hull and has an opposite end which opens into the cavity at a spaced location from the sea opening.

U.S. Pat. No. 4,018,181 to Brix discloses a lateral thrust control unit for watercrafts having a pair of tunnels, which are directed transversely to the longitudinal axis thereof. Each of the tunnels extend from one side of the watercraft to the oppositely positioned side of the watercraft and have at least one drivable propeller therein. At least one pressure-compensating channel is provided near the tunnels and connects at least one of the zones of differing pressure fields created on the sidewalls of the watercraft as the watercraft moves simultaneously longitudinally and laterally to the pressure field of different potential to equalize the pressure differential therebetween and to reduce the resistance to the lateral movement. The pressure-compensating channels do not have any propulsion devices therein.

U.S. Pat. No. 4,214,544 to Dashew, et al. discloses an improved boat thruster including a diverter valve having an inlet connected to a water pump and a pair of outlets extending to either side of the boat. Each outlet includes a primary nozzle and a deflector movable to a first position wherein it allows water flow from the primary nozzle to be discharged to one side to thus thrust the boat to the opposite side. Each deflector is also movable to second and third positions for directing the primary nozzle water flow to respective secondary nozzles for discharging the water either forwardly or rearwardly to thus thrust the boat in the opposite direction. The secondary nozzles each have an exit area smaller than that of the primary nozzle.

U.S. Pat. No. 4,455,960 to Aker discloses an improved boat thruster system including a pump for drawing water through an inlet in the boat hull and for discharging water through first and second pipes connected to outlets located on either side of the hull. A valve is installed in each of the pipes to control the flow of water therethrough. The valves may be controlled be either an open or closed loop control system configured so as to prevent both outlet pipes from being closed at the same time during system operation. Each valve is preferably comprised of multiple vanes each of which is mounted for rotation about an off center axis such that in the event of a valve control system failure, the water flow will cause the valve to open rather than close thereby preventing undesirable high pressure buildup in the system.

U.S. Pat. No. 5,501,072 to Plancich, et al. discloses a thrust propulsion mechanism for a boat including an outlet conduit extending athwartships from a first outlet port to a second outlet port in the hull. A paddle-wheel impeller is mounted within the hull for rotation about an axis of rotation by a reversible motor. A circumferential paddle portion of the paddle-wheel impeller extends into an aperture defined centrally in the top wall of the outlet conduit. An inlet conduit extends athwartships from a first inlet port to a second inlet port, and intermediate thereof supplies water to the center of the paddle-wheel impeller. Water is discharged from the paddle-wheel impeller through one of the outlet ports, dependent on the direction of rotation of the paddle-wheel impeller, to create thrust by a combined paddle-wheel and centrifugal pump action.

U.S. Pat. No. 5,642,684 to Aker discloses an improved thrust director unit provided for discharging a directionally adjustable water jet flow from the hull of a marine vessel to generate a thrust reaction force for close-quarter maneuvering and/or propulsion of the vessel. The unit comprises a thruster housing having an outlet through which the jet flow is discharged, wherein the outlet is defined by diverging fore and aft walls to permit angularly forward or rearward jet flow discharge for vessel propulsion. At least two deflector vanes are moveable together within the housing outlet and cooperate therewith to define a directionally adjustable discharge flow path for selective jet flow discharge in a sideward direction to produce a sideward thrust, or in a forwardly or rearwardly angled direction to respectively produce a reverse or forward propulsion thrust. In the sideward thrust position, the discharge flow path has a nondiverging cross section and is isolated from the diverging fore-aft walls of the housing outlet.

SUMMARY OF THE INVENTION

An object this invention is to improve the control performance of tunnel thrusters at intermediate forward speeds and thus fill the gap in maneuvering effectiveness.

The present invention comprises a tunnel thruster having a means for mitigating the surface pressure difference across the vehicle downstream of the thruster jet and thus eliminates the force which counteracts the force on the thruster blades.

In particular, the invention employs a tubing system to carry fluid between a port located inside the thruster tunnel to distribution manifold located on the vehicle surface aftwards of the tunnel. On the suction side of the tunnel, the distribution holes are located in the high-pressure stagnation region. The port in the tunnel is directed away from the flow. Thus, flow past this port will create suction on the port. Further, the natural flow will be from the distributed surface holes to the port in the tunnel. This flow will bleed pressure from the stagnation region. The port inside the tunnel may be placed inside a scoop facing away form the flow to increase the induced flow through the system. On the discharge side of the tunnel, the port in the tunnel will be directed into the flow so there is a stagnation point on the inlet to drive fluid into the port. The distributed holes in the surface will be located in the low-pressure separation bubble region aftwards of the tunnel. Thus, the natural flow will be from port in the tunnel to low pressure region in the wake deficit. Flow out of the distributed holes will fill in the separation bubble and increase the pressure in this region. The port in the tunnel may be placed inside a scoop facing into the flow to increase the flow through the system.

The system is symmetrical and is driven by the differential pressures created by the tunnel thruster. Thus, when the thruster direction is reversed, the flow through the tubing system will reverse naturally. As effects of the forward vehicle velocity increase the stagnation pressure aft of the tunnel on the suction side, the flow through the system will increase. Similarly, as the separation bubble on the discharge side intensifies, the flow through the manifold system will increase. Thus, this system is passively self-regulating. That is, the pressure differential across the vehicle increases, it will drive more flow through the system thus further mitigating the pressure differential.

In its simplest configuration, the tubing system would be open all of the time (no valves). This would eliminate all moving parts and thus make the system more reliable. The disadvantage of such an arrangement is that some flow would always bleed through the system and this may have a detrimental effect on the thrust when there is no forward vehicle velocity and the bleed system is not required. Also optionally, valves could be installed in the tubing system to close it off when the forward vehicle speed is at or near zero. Optionally, the valves could be controlled by an automated system that opens the valves at a prescribed forward speed.

BRIEF DESCRIPTION OF THE DRAWINGS

Other objects, features and advantages of the present invention will become apparent upon reference to the following description of the preferred embodiments and to the drawing, wherein corresponding reference characters indicate corresponding parts in the drawing and wherein.

DESCRIPTION OF THE PREFERRED EMBODIMENT

Figure 1:
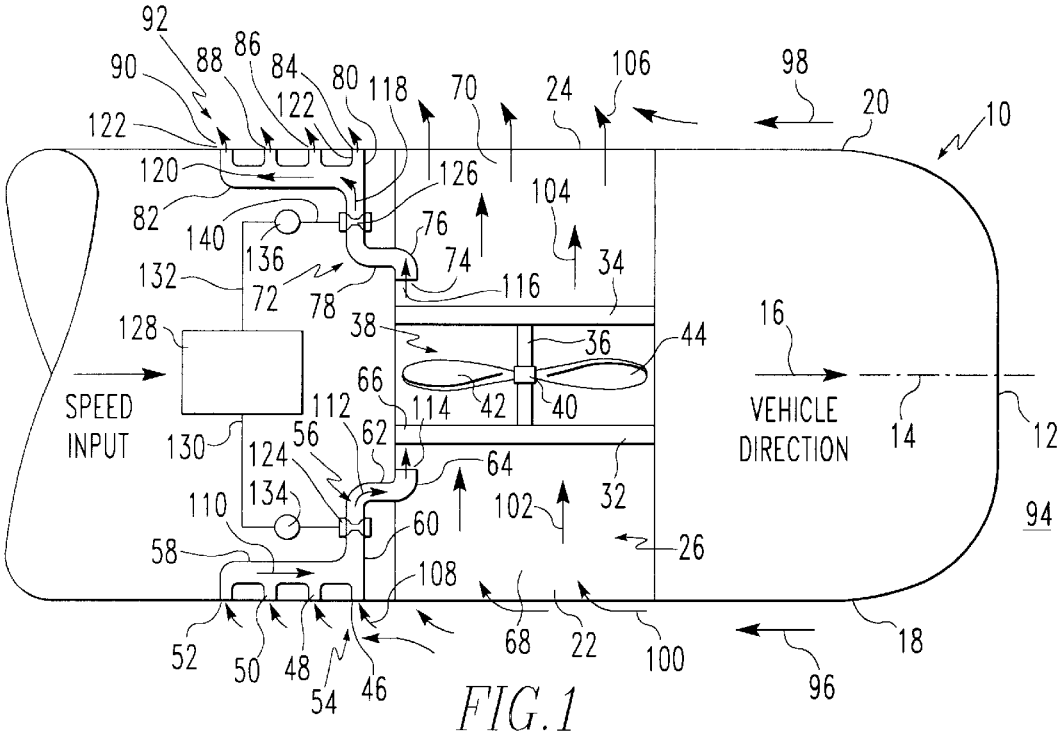
FIG. 1 is a horizontal cross sectional view of a preferred embodiment of the marine vehicle of the present invention.
Figure 2:
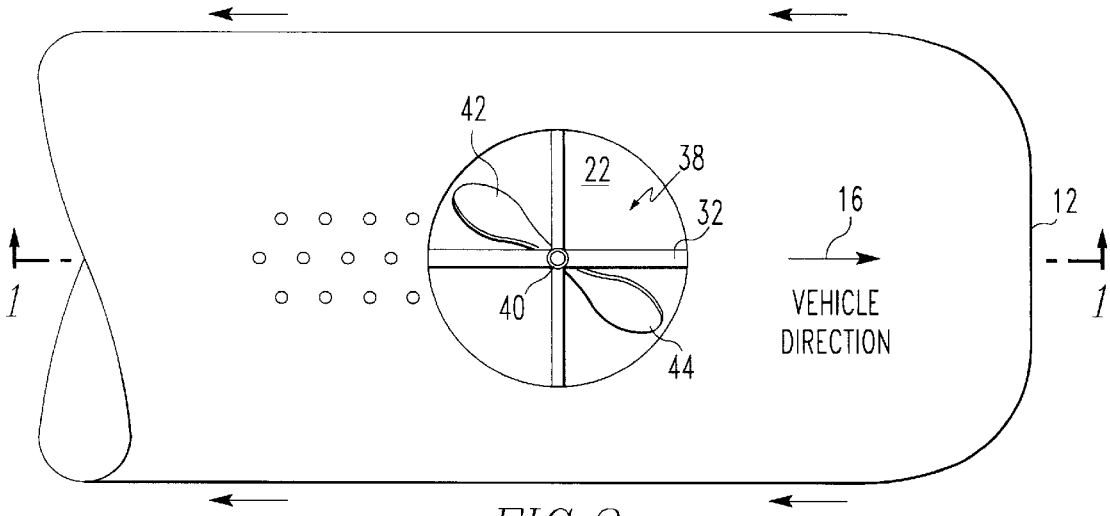
FIG. 2 is a top plan view of the marine vehicle shown in FIG. 1.

Referring to FIGS. 1 and 2, the marine vehicle has a hull 10 with a bow 12 from which a longitudinal axis 14 extends in an aft direction. The ordinary forward movement of the vehicle is in direction of arrow 16 in the direction of bow 12. Hull 10 has a first side 18 and a second side 20. On first side 18 there is a first major opening 22, and in the second side 20 there is a major opening 24. Tunnel 26 extends between such first opening 22 and second opening 24. Medially positioned in the tunnel 26 there are parallel transverse supports, 32 and 34, which are connected by a longitudinal axle 36. Positioned between the transverse supports 32 and 34, there is a propeller 38 which is comprised of a hub 40 mounted on the axle 36 and a plurality of blades as at blades 42 and 44. On the first side 18 of the hull 10 there are a plurality of small openings as at small openings 46, 48, 50 and 52. These small openings are located in an area known as the high pressure stagnation region 54, which will be explained in greater detail hereafter. Between this high-pressure stagnation region 54 and the tunnel 26, there is a first tube 56 that includes a longitudinal header 58 that connects to the small openings 46, 48, 50 and 52. The first tube 56 also includes a transverse section 60, another longitudinal section 62 and another transverse section 64 with a terminal port 66. This port 66 is in a first section 68 of the tunnel 26 between the medial tunnel 38 and the first opening 22. Between the propeller 38 and the second opening 24 of the tunnel 26 there is a second section 70 of the tunnel. In this second section 70 there is a second tube 72 which begins with a port 74 in the second section 70 from where there is a transverse section 76, a longitudinal section 78, another transverse section 80 and a longitudinal header 82. The header 82 connects to a plurality of small openings as at openings 84, 86, 88 and 90 in the second side 20 of the hull 10. These small openings 84, 86, 88 and 90 are in a low-pressure deficit area 92. It will be appreciated that the tunnel 26 comprises a major water conducting means, and the tubes 56 and 72 connecting the small openings 46, 48, 50 and 52 and 80, 84, 86 and 90 are part of a small water conducting means, which coincides over part of its length with the major water conducting means in the tunnel 26. The vehicle is at least partially submerged in water 94. As the vehicle travels in the direction of arrow 16, water moves in a first side flow direction 96 and a second side flow direction 98. When the propeller 38 turns on axle 36 water flows at tunnel input flow direction 100 and tunnel flow directions 102 and 104. Propeller 38 also causes water to flow in a tunnel outflow direction 106. Water also flows in a first side small opening inflow 108, then in first tube flow directions 110 and 112 and a first tube exit direction 114. Water then flows in a second tube flow direction 116 and a second tube intermediate flow direction 118 and then in the second tube longitudinal flow 120 and then in a small opening exit flow 122. The first tube 56 and the second tube 72 are respectively equipped with a first valve 124 and a second valve 126. These valves may be closed at low speeds to prevent water flow through first tube 56 and second tube 72 at low speeds. There is also a speed and valve control 128, which is connected respectively by lines 130 and 132 to secondary valve controls 134 and 136 which are connected respectively by lines 138 and 140 to first valve 124 and second valve 126.

Figure 3:
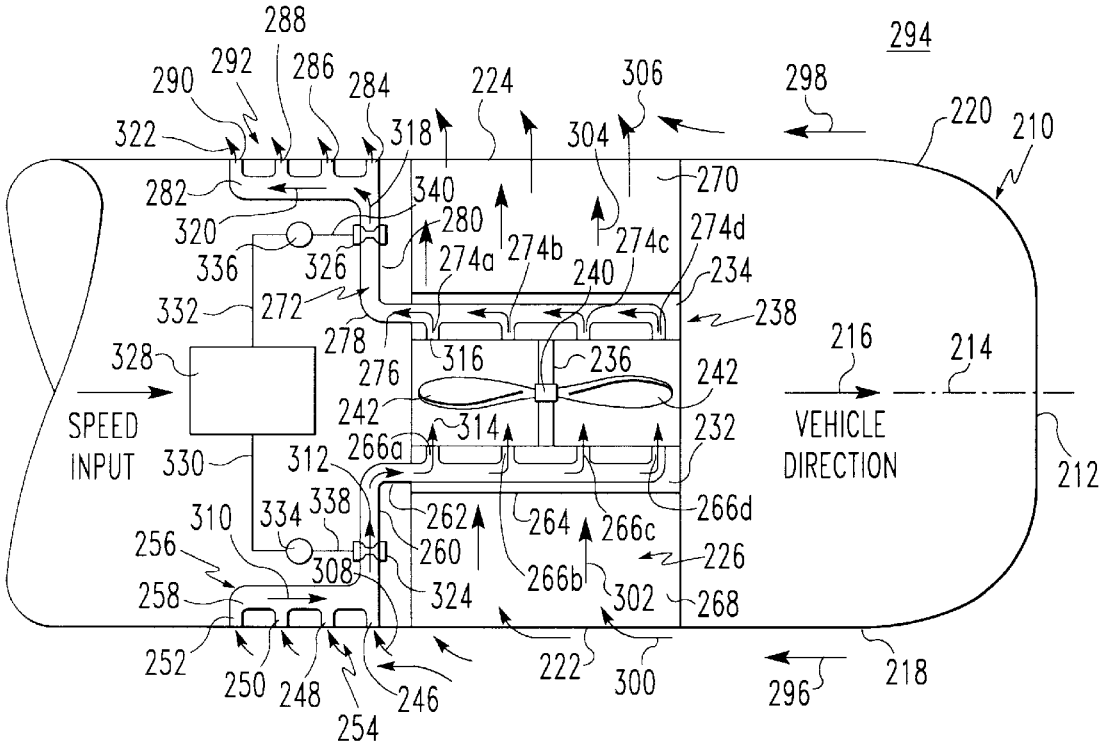
FIG. 3 is a horizontal cross sectional view of an alternate preferred embodiment of the marine vehicle of the present invention.

Referring to FIG. 3, an alternative embodiment of the marine vehicle of this invention has a hull 210 with a bow 212 from which a longitudinal axis 214 extends in an aft direction. The ordinary forward movement of the vehicle is in direction of arrow 216 in the direction of bow 212. Hull 210 has a first side 218 and a second side 220. On first side 218 there is a first major opening 222, and in the second side 220 there is a major opening 224. Tunnel 226 extends between such first opening 222 and second opening 224. Medially positioned in the tunnel 226 there are parallel transverse supports, 232 and 234, which are connected by a longitudinal axle 236. Positioned between the transverse supports 232 and 234, there is a propeller 238 which is comprised of a hub 240 mounted on the axle 236 and a plurality of blades as at blade 242 and 244. On the first side 218 of the hull 210 there are a plurality of small openings as at small openings 246, 248, 250 and 252. These small openings are located in an area known as the high pressure stagnation region 254, which will be explained in greater detail hereafter. Between this high-pressure stagnation region 254 and the tunnel 226, there is a first tube 256 that includes a longitudinal header 258 that connects to the small openings 246, 248, 250 and 252. The first tube 256 also includes a transverse section 260, another longitudinal section 262 and a manifold 264, which extends transversely across the tunnel 226. This manifold 264 has a plurality of axial discharge ports 266*a*, 266*b*, 266*c*, and 266*d*. These ports 266*a*–266*d* are in a first section 268 of the tunnel 226 between the medial propeller 238 and the first opening 222. Between the propeller 238 and the second opening 224 of the tunnel 226 there is a second section 270 of the tunnel. In this second section 270 there is a second tube 272 which begins with intake ports 274*a*, 274*b*, 274*c* and 274*d* in a manifold 276 of the second section 270 and are positioned axially in the tunnel 226 if opposed relation respectively to discharge ports 266*a*, 266*b*, 266*c* and 266*d*. This second section 270 also includes a longitudinal section 278, another transverse section 280 and a longitudinal header 282. The header 282 connects to a plurality of small openings as at openings 284, 286, 288 and 290 in the second side 220 of the hull 210. These small openings 284, 286, 288 and 290 are in a low-pressure deficit area 292. The vehicle is at least partially submerged in water 294. As the vehicle travels in the direction of arrow 216, water moves in a first side flow direction 296 and a second side flow direction 298. When the propeller 238 turns on axle 236 water flows at tunnel input flow direction 300 and tunnel flow directions 302 and 304. Past propeller 238 also causes water to flow in a tunnel outflow direction 306. Water also flows in a first side small opening inflow 308, then in first tube flow directions 310 and 312 and a first tube exit direction 314. Water then flows in a second tube flow direction 316 and a second tube intermediate flow direction 318 and then in the second tube longitudinal flow 320 and then in a small opening exit flow 322. The first tube 256 and the second tube 272 are respectively equipped with a first valve 324 and a second valve 326. These valves may be closed at low speeds to prevent water flow through first tube 256 and second tube 272 at low speeds. There is also a speed and valve control 328, which is connected respectively by lines 330 and 332 to secondary valve controls 334 and 336 which are connected respectively by lines 338 and 340 to first valve 324 and second valve 326.

The advantage of the devices described above is that the effective control force produced by the tunnel thruster will not decrease significantly with forward velocity on the vehicle. Thus, the performance of the thruster in maneuvering the vehicle will be improved by this invention. The new feature is the tubing/manifold system to transfer fluid between the thruster tunnel and the vehicle surface aft of the tunnel thruster.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A marine vehicle having enhanced maneuverability comprising:

a hull at least partially submerged in water having a forward bow, and a longitudinal axis extending rearwardly from said bow and opposed first and second sides and said first and second sides having respectively a first major opening and a first small opening positioned rearwardly of the first major opening and a second major opening and a second small opening positioned rearwardly of the second major opening;

a major water conducting tunnel having a length and extending generally transversely through the hull from the first major opening on the first side of the hull to the second major opening on the said side of the hull;

propeller means for causing water to flow through said major tunnel, and said propeller being mounted on a plurality of parallel supports which extend transversely across said tunnel; and a small water conducting means having a length and extending between the first small opening on the first side of the hull to the second small opening on the second side of the hull and said small water conducting means coincides over at least a part of its length with the length of the major water conducting means.

2. The marine vehicle of claim 1 wherein the vessel is in motion in the direction of the bow.

3. The marine vehicle of claim 2 wherein water flows in the major water conducting means from the first side of the hull to the second side of the hull.

4. The marine vehicle of claim 3 wherein there is a first water pressure on the first side of the hull and a first water pressure on the second side of the vessel and the second water pressure is greater than the second water pressure.

5. The marine vehicle of claim 4 wherein the water flows through the water flow conducting means from the first side of the hull to the second side of the hull to reduce flow stagnation aft of the second major opening.

6. The marine vehicle of claim 1 wherein the tunnel has a first section interposed between the first side of the hull and the propeller and a second section interposed between the propeller and the second side of the hull and the small water conducting means comprises a first tube connecting the first small opening on the first side of the hull and the first section of the tunnel and a second tube connecting the second section of the tunnel and the second small opening on the second side of the hull.

7. The marine vehicle of claim 6 wherein the first tube extends in a first manifold substantially across the tunnel and has a plurality of output ports for allowing water to flow into the tunnel.

8. The marine vehicle of claim 7 wherein the second tube extends in a second manifold substantially across the tunnel and has a plurality of intake ports for receiving water from the tunnel.

9. The marine vehicle of claim 8 wherein the output ports in the first manifold and the intake ports in the second manifold are disposed axially in the tunnel and said output ports are in opposed relation to said input ports.

10. The marine vehicle of claim 1 wherein there are a plurality of first small openings on the first side of the hull and a plurality of second small openings on the second side of the hull.

* * * * *